US006442901B1

(12) United States Patent
Rissone

(10) Patent No.: US 6,442,901 B1
(45) Date of Patent: Sep. 3, 2002

(54) DOOR BOTTOM FOR ALLOWING AIR PASSAGE

(76) Inventor: Robert Rissone, 134 Norcrest Dr., Rochester, NY (US) 14617

( * ) Notice: Subject to any disclaimer, the term of this patent is extended or adjusted under 35 U.S.C. 154(b) by 0 days.

(21) Appl. No.: 09/773,388

(22) Filed: Feb. 1, 2001

(51) Int. Cl.[7] ..... E06B 1/70
(52) U.S. Cl. ..... 49/470; 49/469
(58) Field of Search ..... 49/467, 468, 469, 49/470, 471

(56) References Cited

U.S. PATENT DOCUMENTS 3,504,456 A * 4/1970 Frederick ..... 49/470
4,185,417 A * 1/1980 McKann ..... 49/470
4,945,680 A * 8/1990 Giguere ..... 49/467
5,150,544 A * 9/1992 Burnett ..... 49/470
5,174,065 A * 12/1992 Schlicht ..... 49/470
6,058,654 A 5/2000 Rissone

* cited by examiner

*Primary Examiner*—Jerry Redman
(74) *Attorney, Agent, or Firm*—Nixon & Vanderhye P.C.

(57) ABSTRACT

A door bottom seal is provided for reducing light and/or noise flow through a door bottom area when a door is closed, while at the same time allowing air flow through the same. In certain embodiments, the door bottom seal includes at least first and second removable inserts, each of the inserts having a plurality of spaced apart sealing members provided thereon. Sealing members of the first insert may at least partially overlap gaps between sealing members of the second insert, in order to reduce light and/or noise flow while enabling air flow through the door bottom seal.

13 Claims, 14 Drawing Sheets

21
33
55
45
39
61
43
47
51
51
47
47

21
29
55
33
HINGE EDGE
OF DOOR
39
47
61
25
47
31

WEDGE CAPS

WEDGE CAPS

DOOR BOTTOM FOR ALLOWING AIR PASSAGE

This application relates to a door bottom for use in conjunction with a door and corresponding door threshold. More particular, this invention relates to a door bottom design which functions to allow air to pass to/from a room but at the same time blocks substantial portions of light and/or noise. Door bottom seals herein may be used in hotel room doors and/or any other suitable application/environment.

BACKGROUND OF THE INVENTION

U.S. Pat. No. 6,058,654 discloses a door bottom for use in conjunction with a door and corresponding door threshold. As shown in FIG. 1 of the instant application, door 1 is attached to door frame 3 via at least one hinge 5. A pivotable door bottom member 7 is attached to an interior face of door 1 for security reasons. The door bottom includes a base 9 which is attached to the interior face of door 1, and a flap 11 which pivots upward/downward as the door is opened/closed. Stop member 13, which is affixed to the door frame via screws 15, is utilized to keep flap 11 in a down position when door 1 is in a closed state against stop 17. Further details regarding the door bottom of FIG. 1 may be found in U.S. Pat. No. 6,058,654, the disclosure of which is hereby incorporated herein by reference.

Doors are often utilized in hotel room applications. It is desirable for air to be able to flow into and out of a room (e.g., hotel room) regardless of whether the door to the room is opened or closed. For example, it is often desired to draw air into a hotel room from the hallway of a hotel in order to feed bathroom fans and/or air conditioners.

Thus, an air tight door threshold is not desirable. An air tight design would prevent air from flowing into a hotel room for purposes of air conditioners and/or bathroom fans from an exterior hallway, whenever the door was closed. Moreover, an air tight door threshold seal may result in door closing difficulties (i.e., if a room is so tight that air cannot escape under a door as it closes, it may be difficult to close the door).

As can be seen from the above, it is desirable to have air flow beneath doors in hotel room applications as well as other applications. However, this desire is contrasted by: (1) certain fire codes require tight seals at door bottoms (e.g., NFPA 105); (2) hotel room guests prefer that light does not enter their room in significant amounts from the hallway whenever the door is closed and the lights inside the room have been turned off; and (3) hotel room guests desire minimum noise to penetrate their room from the hallway whenever the door is closed.

As can be seen from the above, there exists a need in the art to both meet fire codes requiring tight seals at door bottoms, while simultaneously blocking substantial light and/or noise from entering a room from the hallway or other exterior area when the door is closed. In other words, there exists a need in the art to provide a door bottom seal/threshold which can block substantial light, block substantial sound, and block substantial smoke all at the same time, while simultaneously allowing for air flow to/from the room interior when the door is closed.

SUMMARY OF THE INVENTION

An object of this invention is to provide a door bottom seal which meets certain fire codes while simultaneously allowing air to flow to/from a room when the door is closed.

Another object of this invention is to provide a door bottom seal which blocks light and allows air flow to/from an interior of the room when the room's door is closed.

Another object of this invention is to provide a door bottom seal which can block substantial light and/or noise from passing into a room when the door is closed, while simultaneously allowing air flow to/from the room.

Another object of this invention is to fulfill one or more of the above listed need(s) and/or object(s).

In one example embodiment, one or more of the above listed needs and/or objects may be fulfilled by providing a door bottom seal comprising:

a door having a cavity defined in a bottom surface thereof;

a seal support being provided at least partially in said cavity;

said seal support including at least first and second elongated channels which are approximately parallel to one another;

first and second elongated and removable seal inserts positioned in said first and second elongated channels, respectively, wherein each of said first and second removable inserts includes a plurality of spaced apart sealing members extending downwardly toward a door threshold; and wherein said sealing members of said first insert at least partially overlap respective gaps between sealing members of said second insert in order to reduce light flow through the door bottom seal while permitting air flow through the door bottom seal.

DETAILED DESCRIPTION OF CERTAIN EMBODIMENTS

Figure 1A:
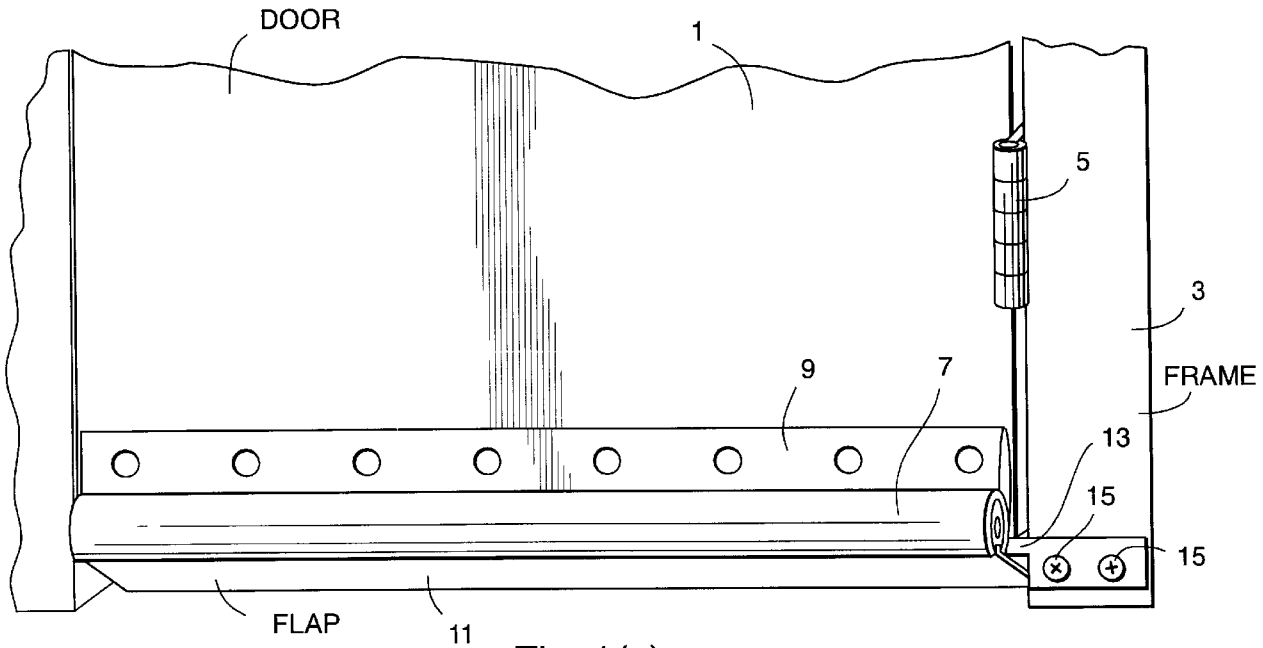
FIG. 1*a* is a plan view illustrating a door bottom as viewed from the interior of a room when the door is in a closed state.
Figure 1B:
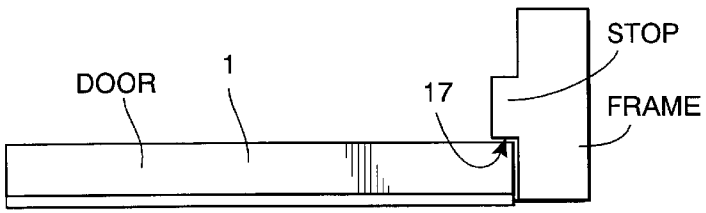
FIG. 1*b* is a top plan view of the door of FIG. 1*a*, when the door is in a closed state.

Referring now more particularly to the accompanying drawings in which like reference numerals indicate like parts throughout the several views.

Figure 2B:
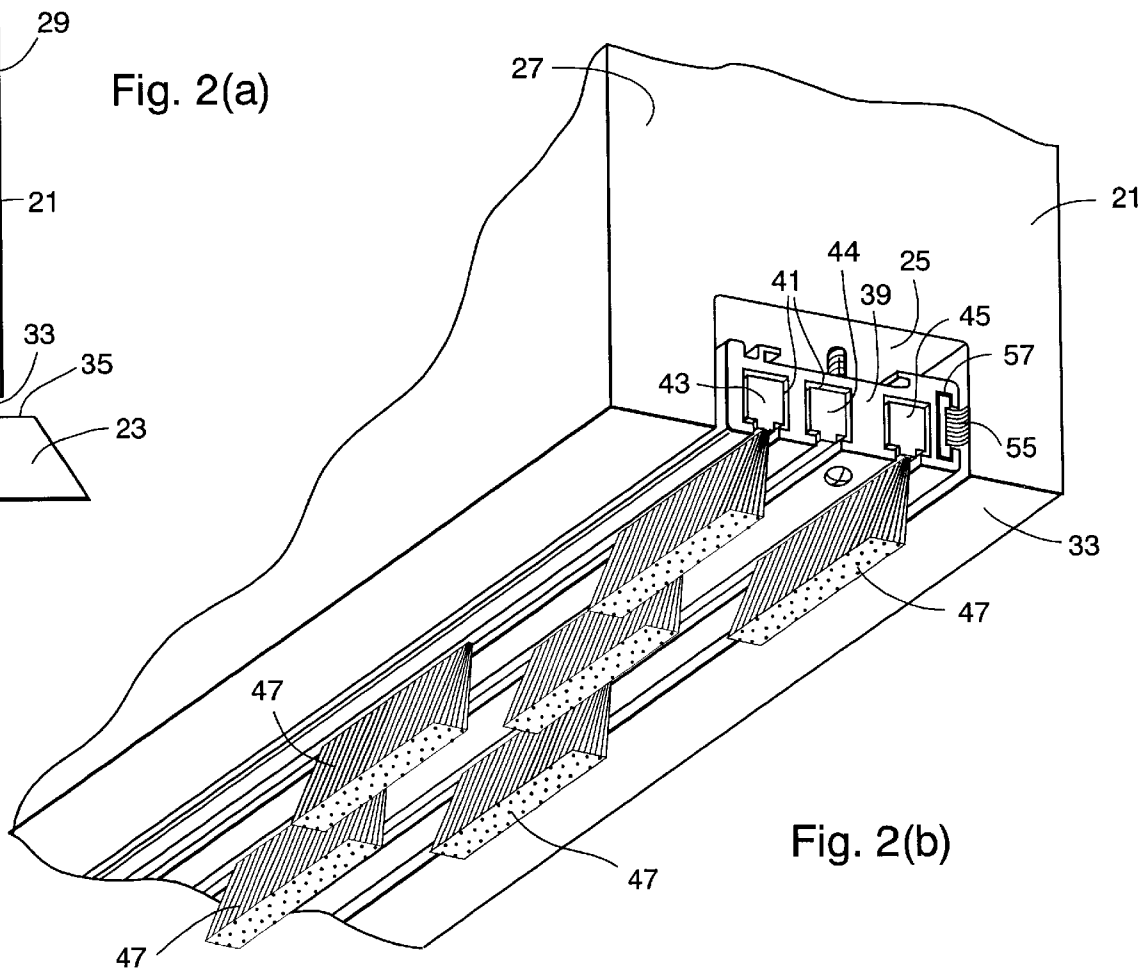
FIG. 2*b* is a perspective view of the door bottom seal of FIG. 2*a*.
Figure 2A:
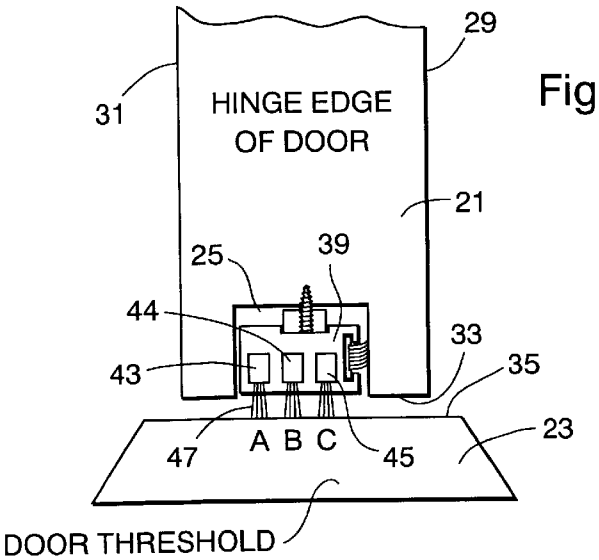
FIG. 2*a* is a side cross-sectional view of a door and corresponding door bottom seal according to an embodiment of this invention.

FIG. 2 illustrates a door bottom seal according to a first embodiment of this invention. As shown in FIG. 2*a*–2*b*, the sealing arrangement includes door 21, door threshold 23, and a door bottom sealing arrangement provided in a cavity or cutout (e.g., mortise) 25 defined in a bottom surface of door 21. Door 21 includes an edge surface 27, an interior major surface 29, exterior major surface 31, and bottom surface 33. Bottom surface 33 of the door faces the top surface 35 of threshold 23. As can be seen, recess or cavity 25 is provided in the bottom surface 33 of door 21.

Seal support 39 is mounted inside of cavity 25 via screws or the like. Support 39 includes a plurality of different approximately parallel elongated channels 41 defined therein which receive corresponding replaceable elongated and approximately parallel inserts 43, 44, and 45. In the FIG. 2 embodiment, each of replaceable inserts 43–45 includes a plurality of spaced apart aligned bristle portions 47 which provide a sealing function between the bottom surface of door 21 and the threshold 23. The bristles may or may not contact the threshold in different embodiments of this invention, but preferably are at least closely proximate thereto.

Figure 2C:
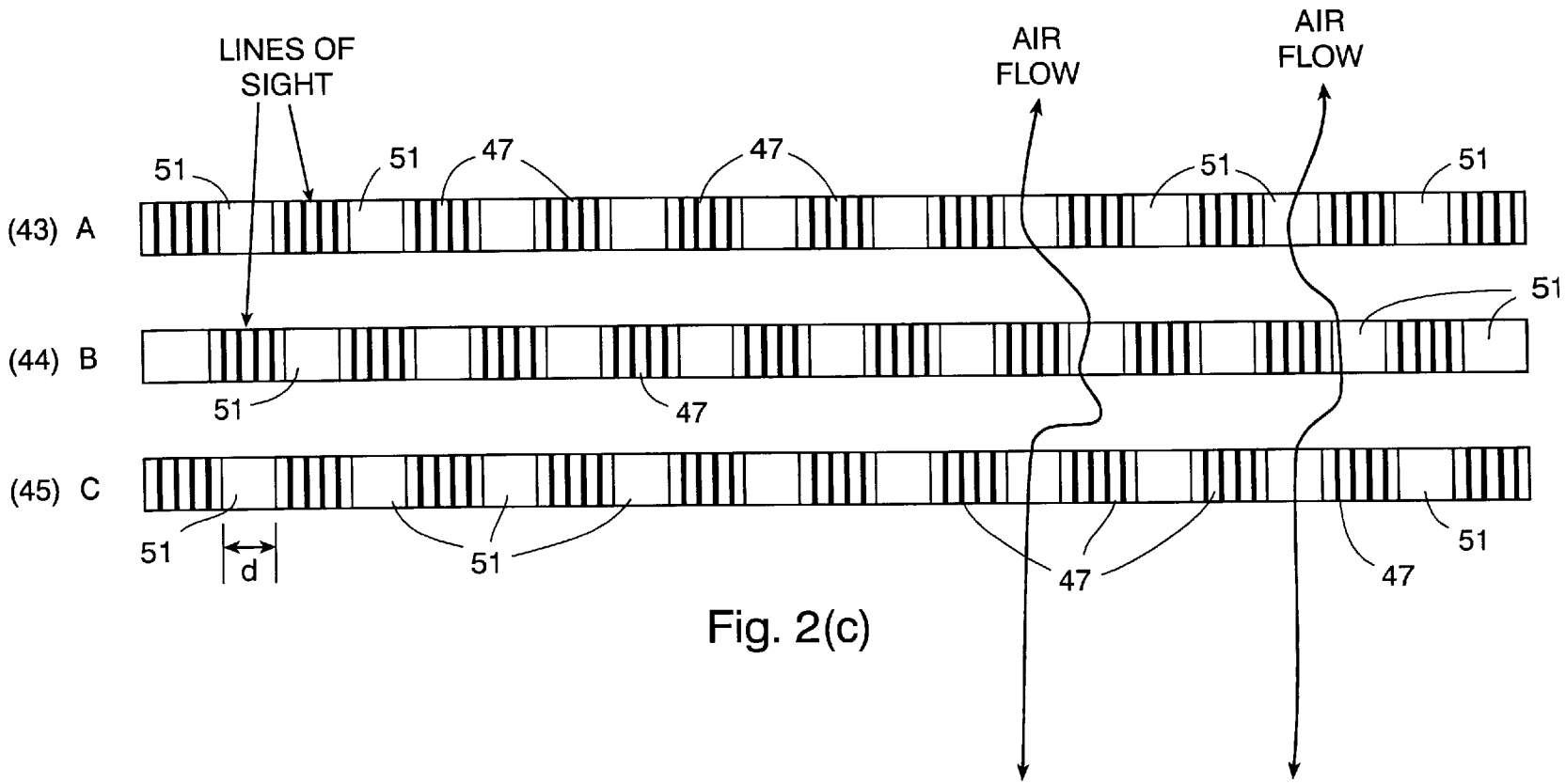
FIG. 2*c* is a schematic diagram illustrating from a top perspective the locations of the sealing members of the door bottom seal of FIGS. 2*a* and 2*b*.

An important feature of the instant invention is the fact that bristle sealing portions 47 from adjacent or different inserts 43–45 are laterally offset and/or overlapping relative to one another as shown in FIGS. 2*b* and 2*c*. Referring in particular to FIG. 2*c*, the bristles 47 of insert 43 are shown at "A", while the bristles 47 of insert 44 are shown at "B" while the bristles 47 of insert 45 are shown at "C." As can be seen, the bristles 47 for each of the inserts are laterally spaced from bristle portions of adjacent inserts. A gap ("d"or 51) is provided between adjacent bristle sealing portions on each insert. Air is thus permitted to flow through gaps 51 provided between adjacent bristle sealing portions 47. Light also is permitted to pass through gaps 51 between adjacent sealing portions 47. However, as shown in FIGS. 2*b* and 2*c*, the sealing portions 47 of insert 43 (A) at least partially overlap and/or cover gaps 51 located in insert 44 (B). Moreover, bristle sealing portions 47 of insert 44 (B) are spaced from but at least partially overlap and/or cover gaps 51 of insert 43 (A). The same is preferably true with regard to inserts 44 and 45 (B and C). Thus, as shown in FIG. 2*c*, the straight line of sight of a viewer (or a light ray path) is blocked by at least one sealing portion 47 regardless of how the viewer attempts to look through the door seal when viewing it from at least a perpendicular or straight on position.

As a result, the door bottom seal of FIG. 2, including sealing portions of one insert which overlap gaps in another insert, enables air to flow to/from a room through the seal whenever the door is closed or is being closed, but at the same time blocks substantial portions of light from entering the room from the hallway (e.g., when the hallway outside the door/room is lit and the room has no lights turned on at night). Moreover, by deflecting the air flow as it flows through the door bottom seal so as to cause it to make a number of turns, the amount of sound which passes through the door bottom seal may be decreased or reduced.

In certain embodiments of this invention, the flexible bristles making up each sealing portion 47 maybe made of any suitable material (e.g., plastic, PVC, metal wire, etc.). Moreover, support 39 may be made of wood, or more preferably injection molded plastic, or any other suitable material.

As shown in FIGS. 2*a* and 2*b*, a continuous elongated bristle seal 55 may be provided in a channel 57 of support 39 on a side edge thereof so as to be aligned approximately perpendicular to bristle sealing portions 47. Sealing portion 55 is preferably continuous along the length of the door, and functions to e.g., prevent smoke and the like from traveling upwardly into cavity 25 around support 39. Flexible bristles of sealing portion 55 preferably contact the surface of cavity 25 as shown in FIG. 2*b*, in a manner similar to flexible bristles of sealing portions 47 preferably contacting a top 35 of door threshold 23 in some embodiments.

Figures 3A, 3B:
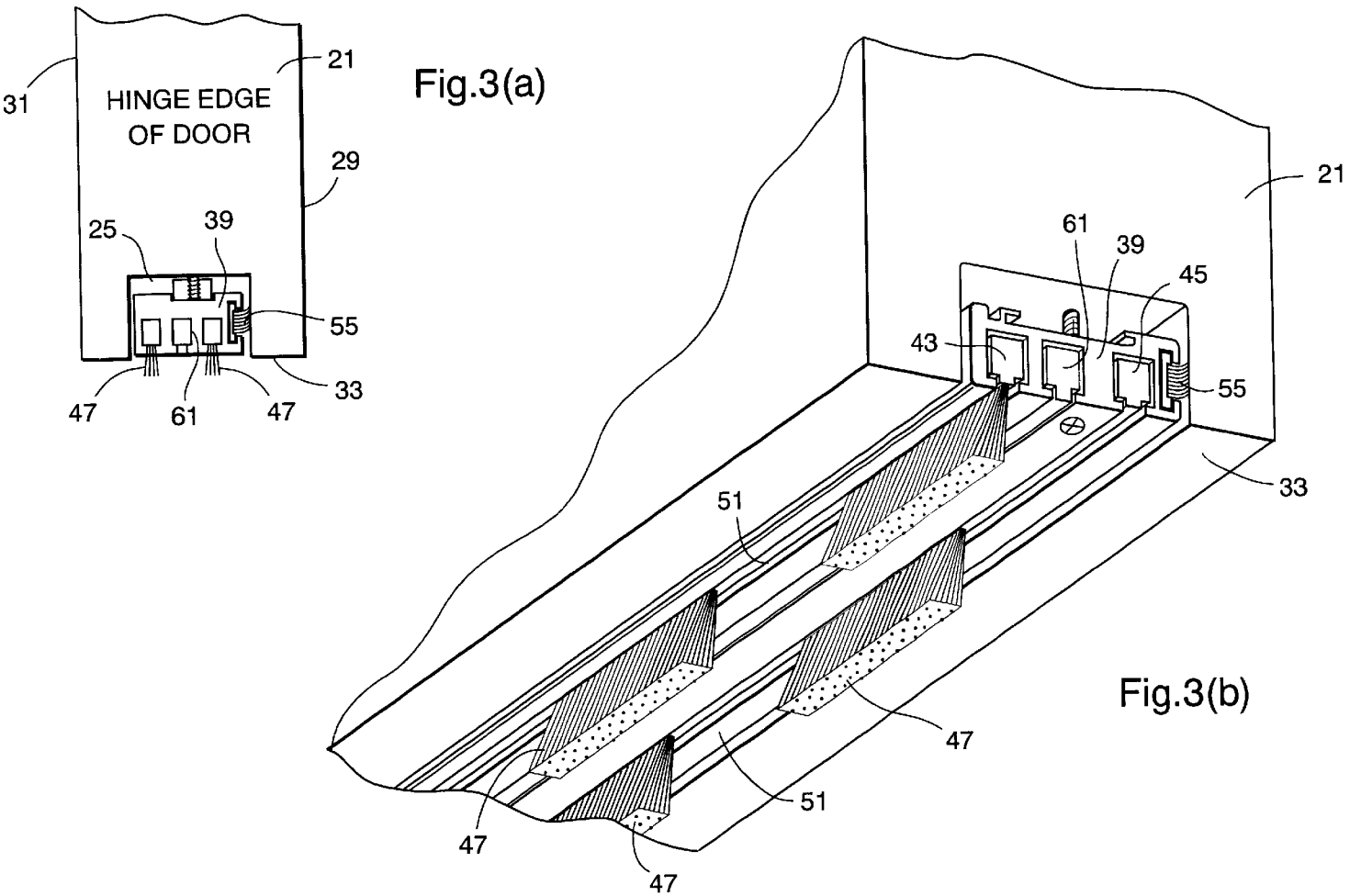
FIG. 3*a* is a side cross-sectional view of a door bottom seal according to another embodiment of this invention.
FIG. 3*b* is a perspective view of the door bottom seal of FIG. 3*a*.

FIG. 3 illustrates another embodiment of this invention. The FIG. 3 embodiment is similar to the FIG. 2 embodiment, except that insert 44 of the FIG. 2 embodiment is replaced with an intumescent insert 61 in FIG. 3. The intumescent material of insert 61 (e.g., sodium silicate) preferably expands and creates a seal between the door bottom and the top of threshold 23 upon exposure to high temperatures (e.g., 400 degrees F). This may act as a smoke seal during fire conditions. However, even when the intumescent insert 61 is provided, the bristles 47 of insert 43 still preferably overlap (at least partially, and more preferably fully) and/or cover gaps 51 provided between the bristles of insert 45 so as to reduce light and/or noise flow while allowing air flow as discussed above.

Figures 4A, 4B:
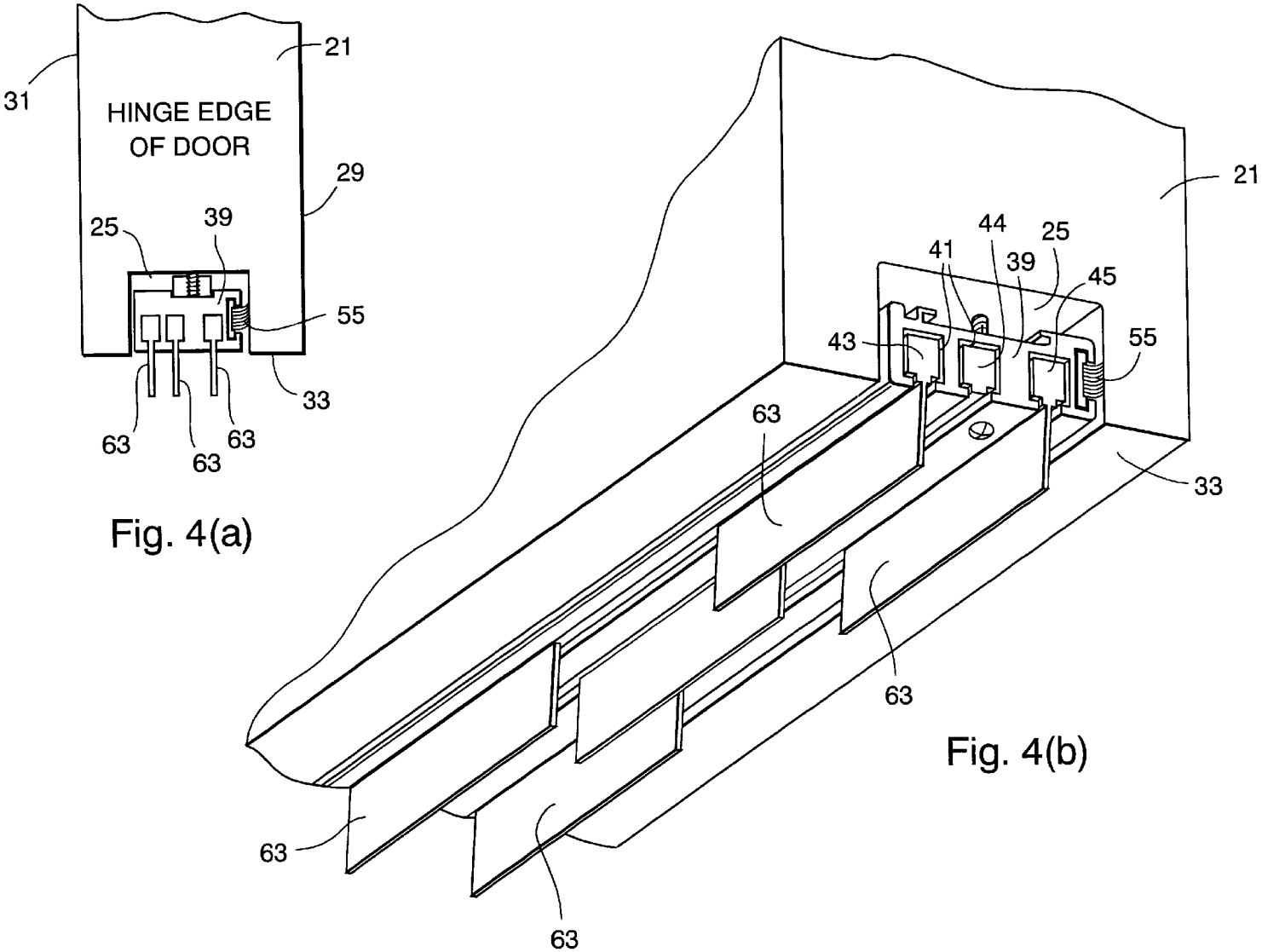
FIG. 4*a* is a side cross-sectional view of a door bottom seal according to yet another embodiment of this invention.
FIG. 4*b* is a perspective view of the door bottom seal of FIG. 4*a*.

FIG. 4 illustrates a door bottom seal according to another embodiment of this invention. The FIG. 4 embodiment is similar to the FIG. 2 embodiment, except that sheet-like flexible polymer seals (or fins) 63 are used instead of flexible bristles 47.

Figures 5A, 5B:
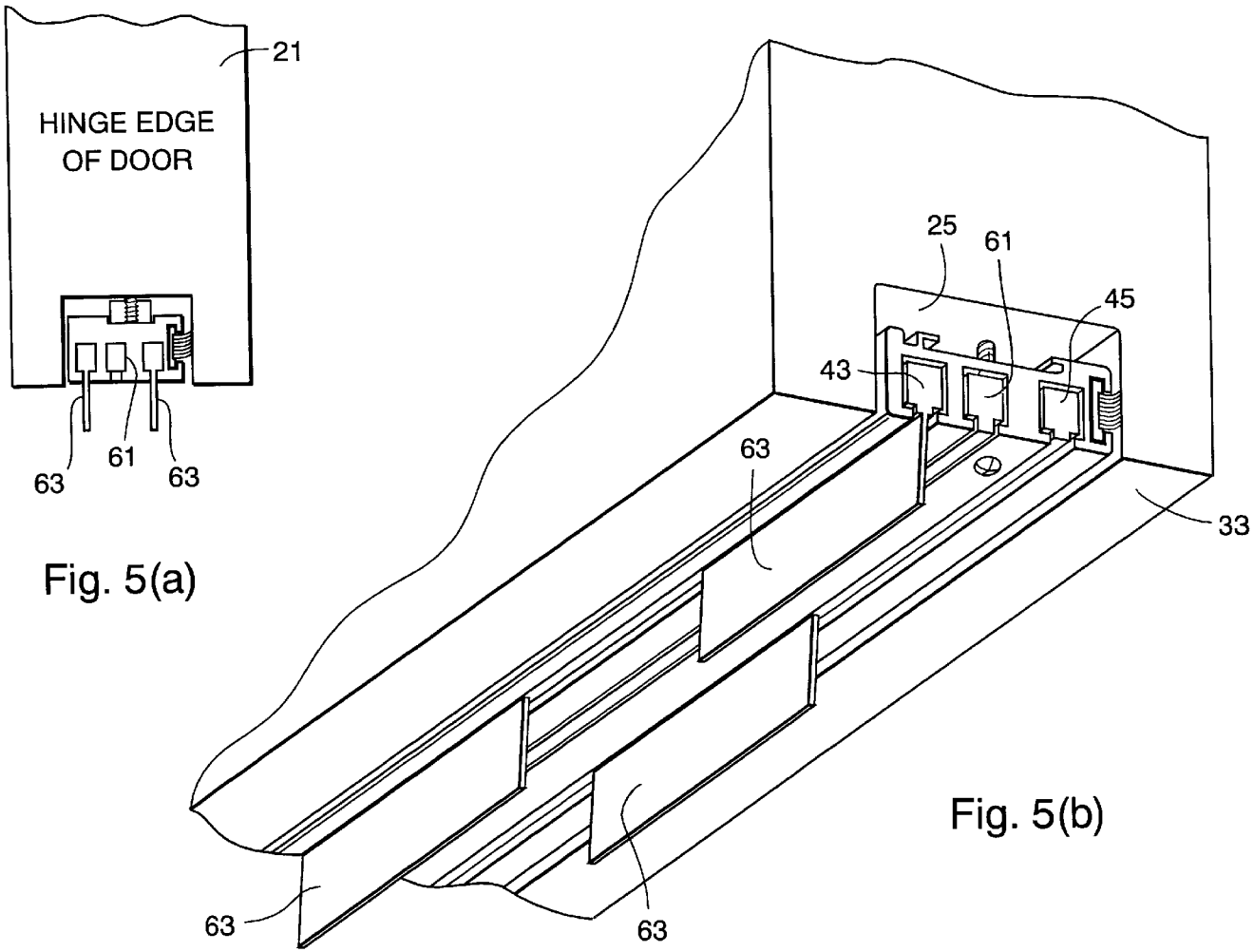
FIG. 5*a* is a side cross-sectional view of a door bottom seal according to another embodiment of this invention.
FIG. 5*b* is a perspective view of the door bottom seal of FIG. 5*a*.

FIG. 5 illustrates a door bottom seal according to yet another embodiment of this invention. The FIG. 5 embodiment is similar to the FIG. 3 embodiment, except that flexible sheet-like polymer seal members 63 (fins) are utilized instead of bristles 47.

Figure 6A:
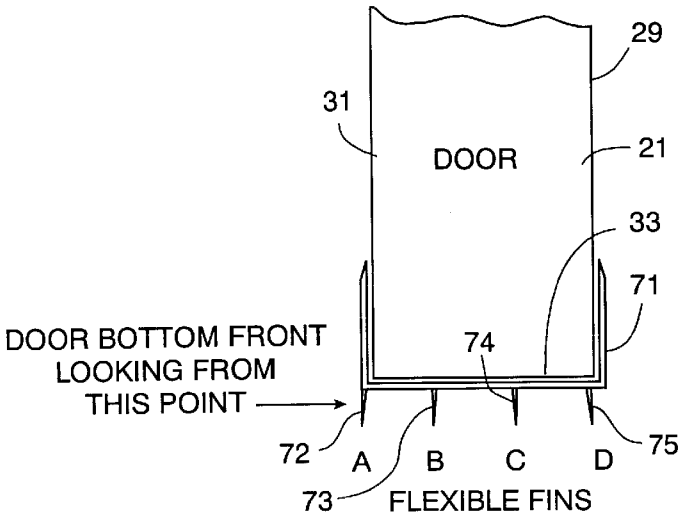
FIG. 6*a* is a side cross-sectional view of a door bottom seal according to yet another embodiment of this invention.
Figure 6B:
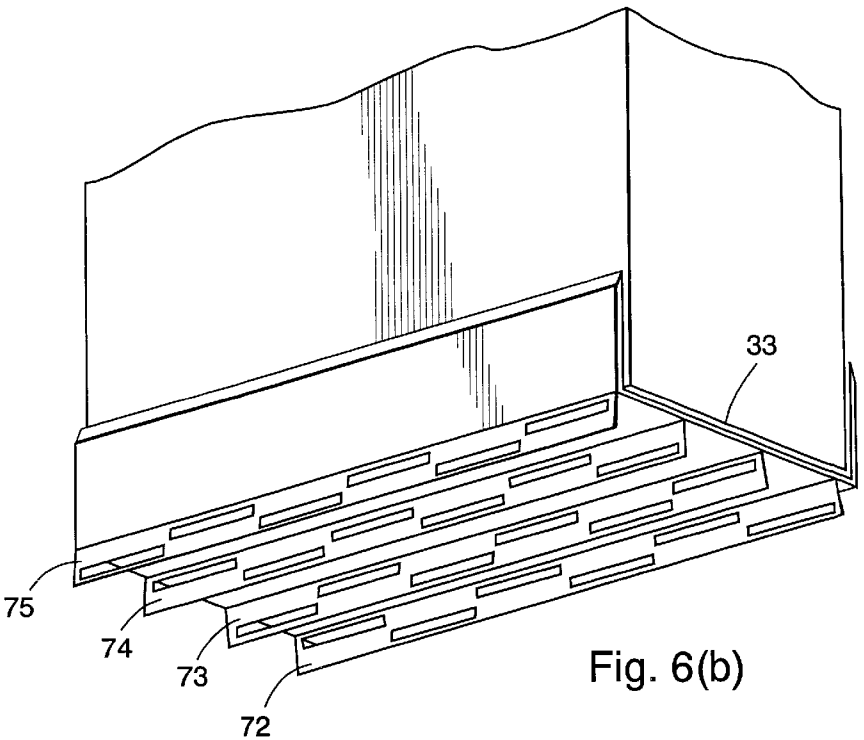
FIG. 6*b* is a perspective view of the door bottom seal of FIG. 6*a*.
Figure 6C:
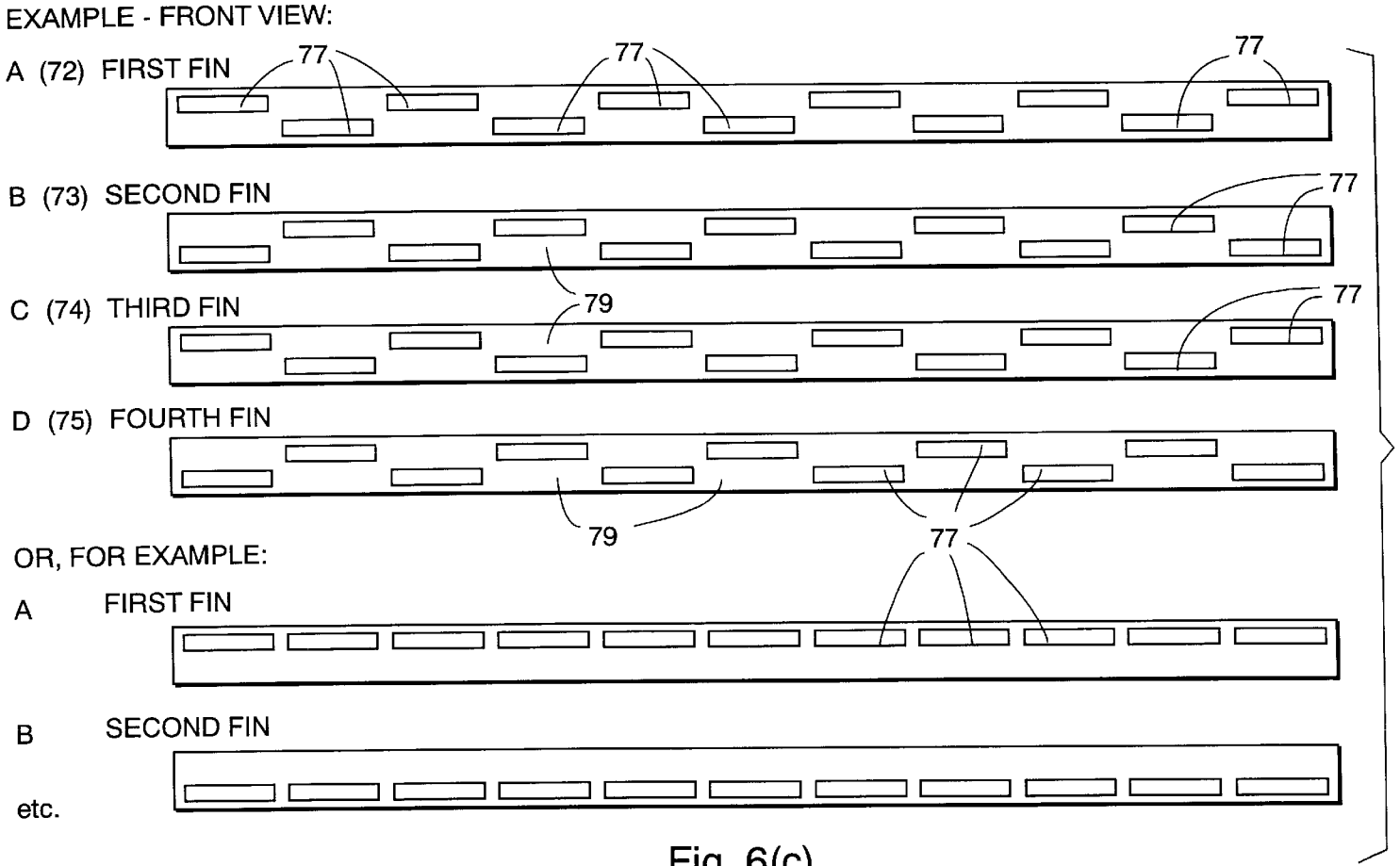
FIG. 6*c* is a diagram illustrating alternative arrangements of the door bottom seal members of FIGS. 6*a* and 6*b* as viewed from above.

FIG. 6 illustrates another embodiment of this invention. As shown in FIG. 6*a*, a support member 71 (e.g., made of plastic) is provided and attached to at least the bottom surface of door 21. Upon support 71 are mounted a plurality of approximately parallel and spaced apart elongated flexible sealing members 72–75. These flexible sealing members 72–75 may also be referred to as fins. Each of the flexible sealing members 72–75 includes a plurality of apertures or holes provided therein as shown in FIGS. 6*b* and 6*c*. These apertures are referred to by reference numerals 77. However, solid portions 79 of certain sealing members overlap laterally apertures 77 of other sealing member (s) in order to block a viewers line of sight through the overall door bottom. Accordingly, in a manner similar to the embodiments discussed above relative to FIGS. 2–5, air is permitted to travel through the door bottom while light and/or noise flow is substantially reduced. Four fins may be utilized as shown in FIGS. 6*a* and 6*b*. Alternatively, only two fins need be utilized in other embodiments of this invention as shown in the lower section of FIG. 6c. Three or more fins may also be used.

Figure 7A:
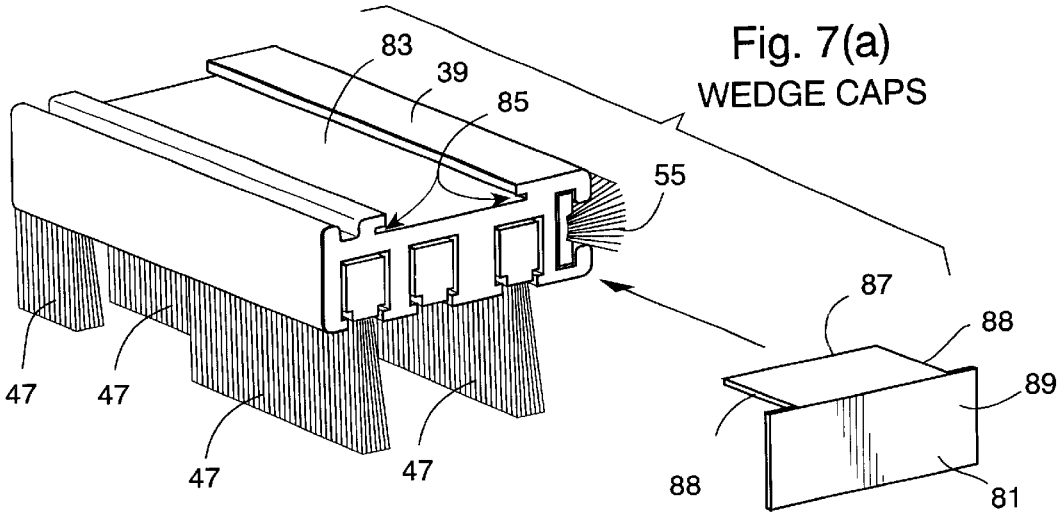
FIG. 7*a* is an exploded perspective view illustrating how a wedge cap can be utilized in conjunction with a door bottom seal according to an embodiment of this invention.
Figure 7B:
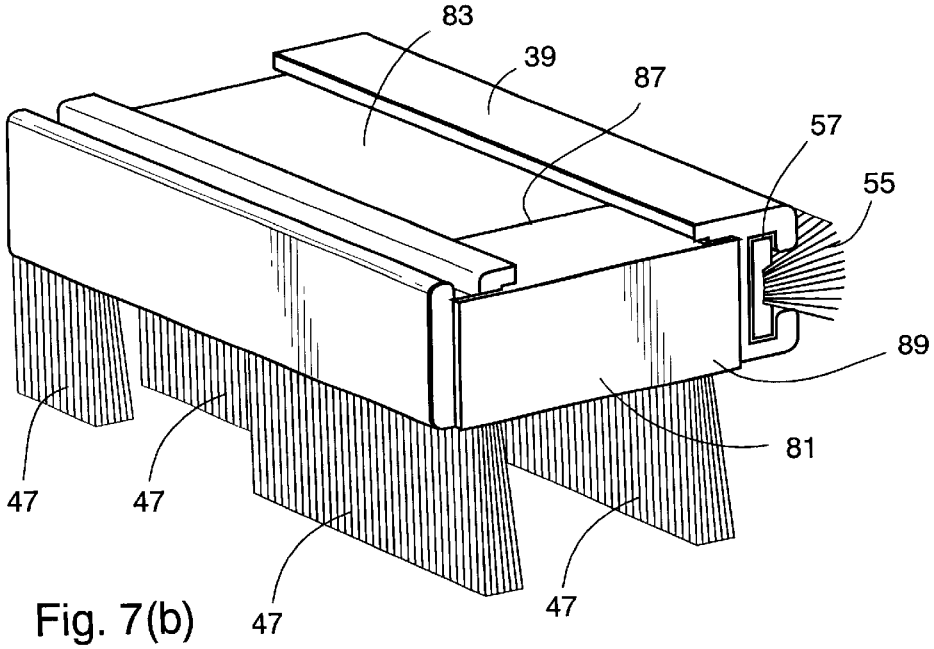
FIG. 7*b* is a perspective view illustrating the wedge cap of FIG. 7*a* in position.

FIG. 7 illustrates that wedge caps or end caps 81 may be utilized in order to aesthetically cover end portions of sealing arrangements herein. These caps may be utilized regardless of whether cavities 25 extend all the way to door edges or not. In particular, a top portion of support 39 includes a channel 83 defined therein. Channel 83 includes a pair of overhang portions 85 at opposite sides thereof. When leading edge 87 of cap 81 is slid into channel 83, the two sides 88 thereof slide under overhang portions 85 in channel 83. In such a manner, the cap 81 may be slid into channel 83 in an efficient manner, while base or tab portion 89 thereof ends up covering up the removable inserts. When it is desired to remove the inserts, tab 89 may be bent upwardly and pulled so as to remove the cap so that thereafter the insert may also be removed.

Figure 8A:
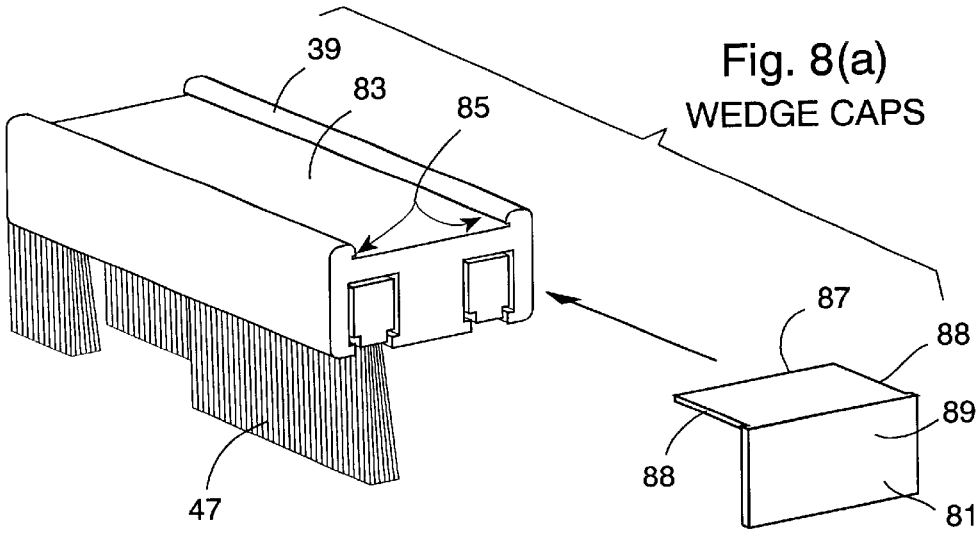
FIG. 8*a* is an exploded perspective view illustrating how a wedge cap can be utilized in order to cover and end of a door bottom seal arrangement according to an embodiment of this invention.
Figure 8B:
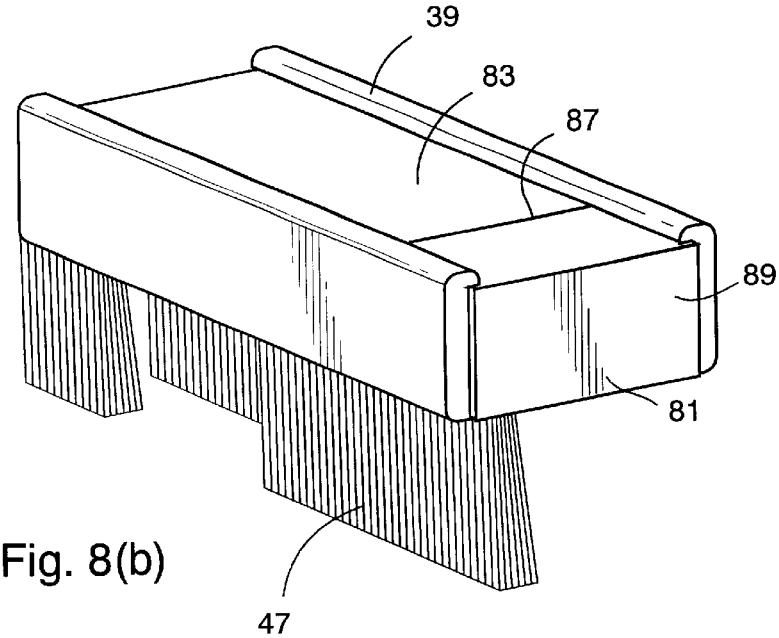
FIG. 8*b* is a perspective view illustrating the wedge cap of FIG. 8*a* in final/installed position.

FIG. 8 illustrates another version of an end cap being slid into a similar channel 83 according to an embodiment of this invention.

Figure 9:
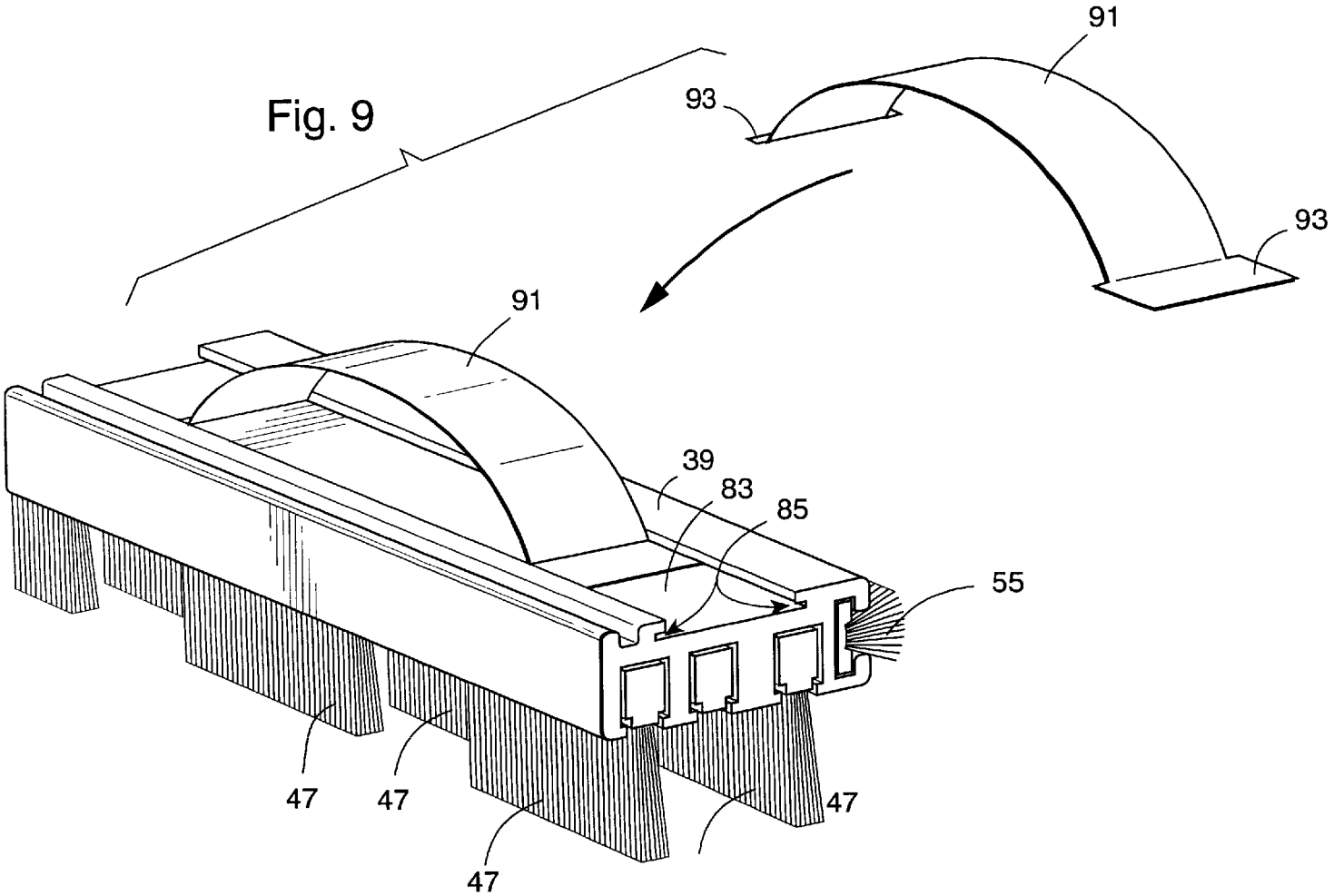
FIG. 9 is a perspective view illustrating how a leaf spring can be utilized in conjunction with a door bottom seal in order to bias the seal downward against a door threshold according to an embodiment of this invention.

FIG. 9 illustrates an embodiment of this invention which may be utilized in conjunction with any of the aforesaid embodiments. In the FIG. 9 embodiment, flexible leaf spring 91 is slidable into channel 83. Leaf spring 91 includes an arc shaped portion as well as approximately flat tabs 93 which may be positioned in channel 83. Edges of tabs 93 slide under overhang portions 85 in the channel. Leaf spring 91 causes the sealing arrangement including seals 47 (or 63) to be biased downwardly against the upper surface of the door threshold 23 so as to create a good seal therebetween.

Figure 10:
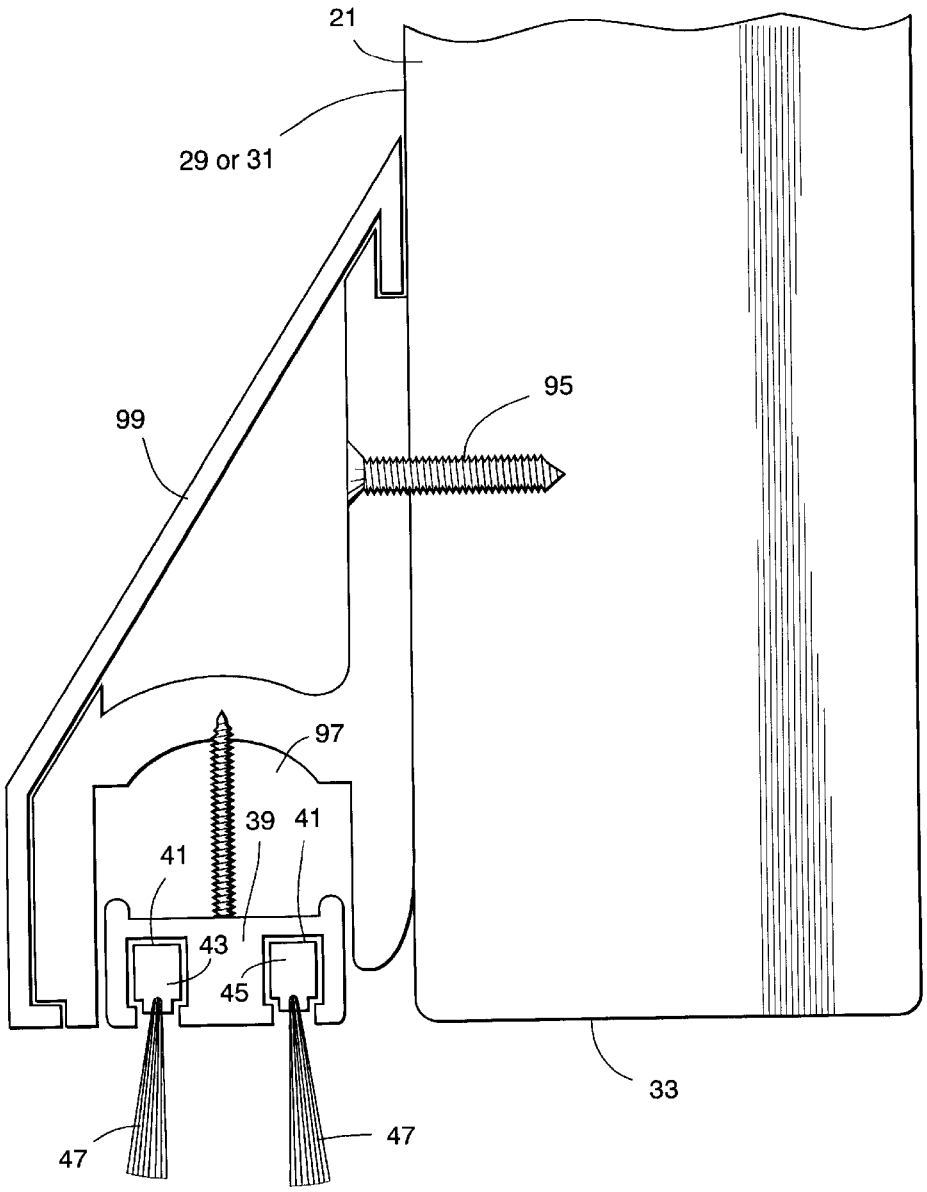
FIG. 10 is a side cross-sectional view of a door bottom seal according to yet another embodiment of this invention.

FIG. 10 illustrates another embodiment of this invention. The FIG. 10 embodiment differs from previous embodiments in that the sealing arrangement is not provided on or in the bottom edge 33 of door 21. Instead, in the FIG. 10 embodiment, the sealing arrangement is provided on either the interior or exterior face 29, 31, of the door 21. It is attached to the face via at least one screw 95. Seal support 39 is provided in a cavity 97 of supporting frame 99. It is supporting frame 99 that is affixed to the door face via screw 95. The bristles 47 (or other sealing members) of the FIG. 10 embodiment may be arranged as discussed above with regard to any of the embodiment of FIGS. 2 through 8.

Figure 11:
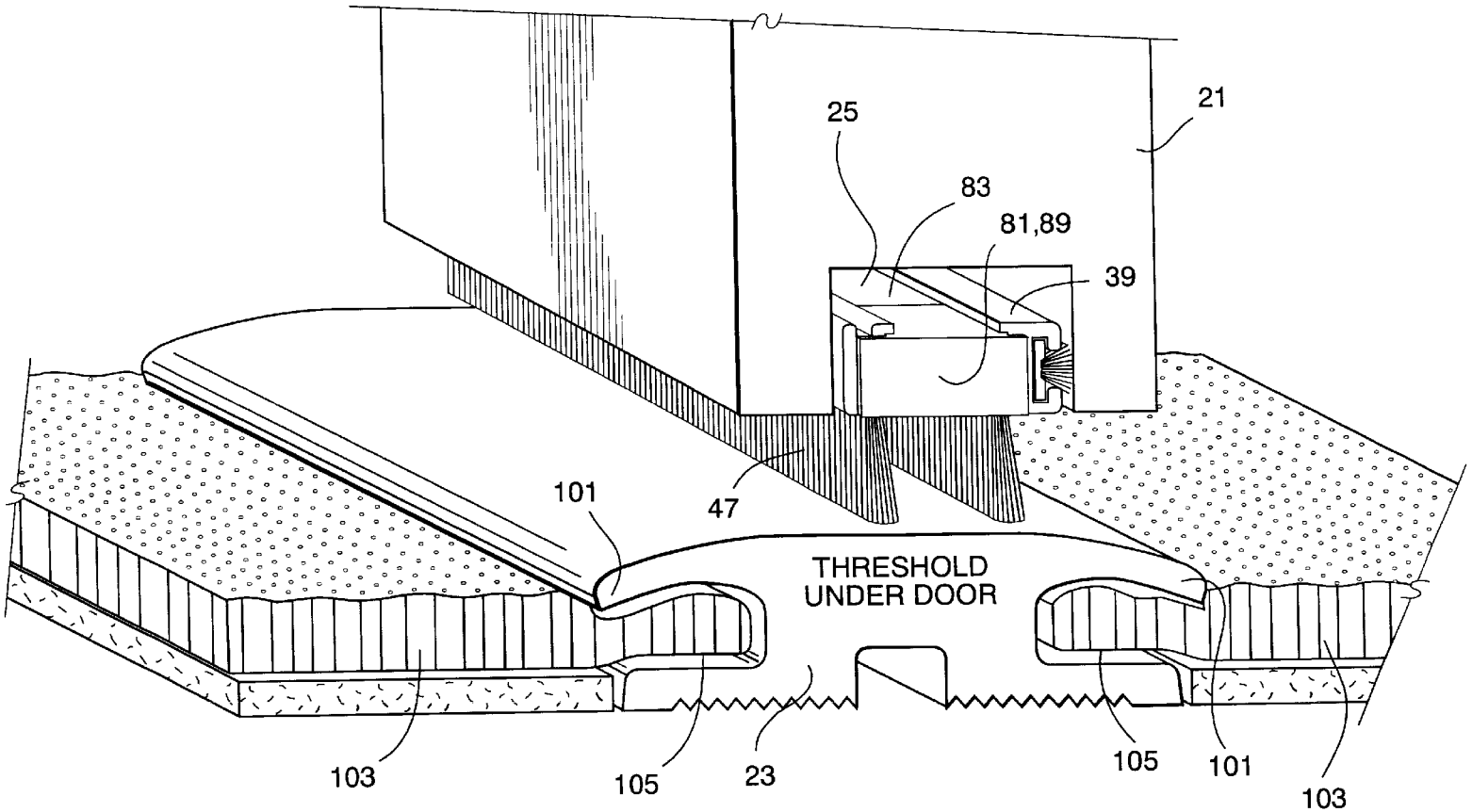
FIG. 11 is a perspective partial cross-sectional view of a door threshold which is being utilized in conjunction with any of the FIG. 2–3 or 7–9 embodiments of this invention (this threshold may stand on its own in certain embodiments of this invention, and need not be used in conjunction with seals herein).
Figure 12:
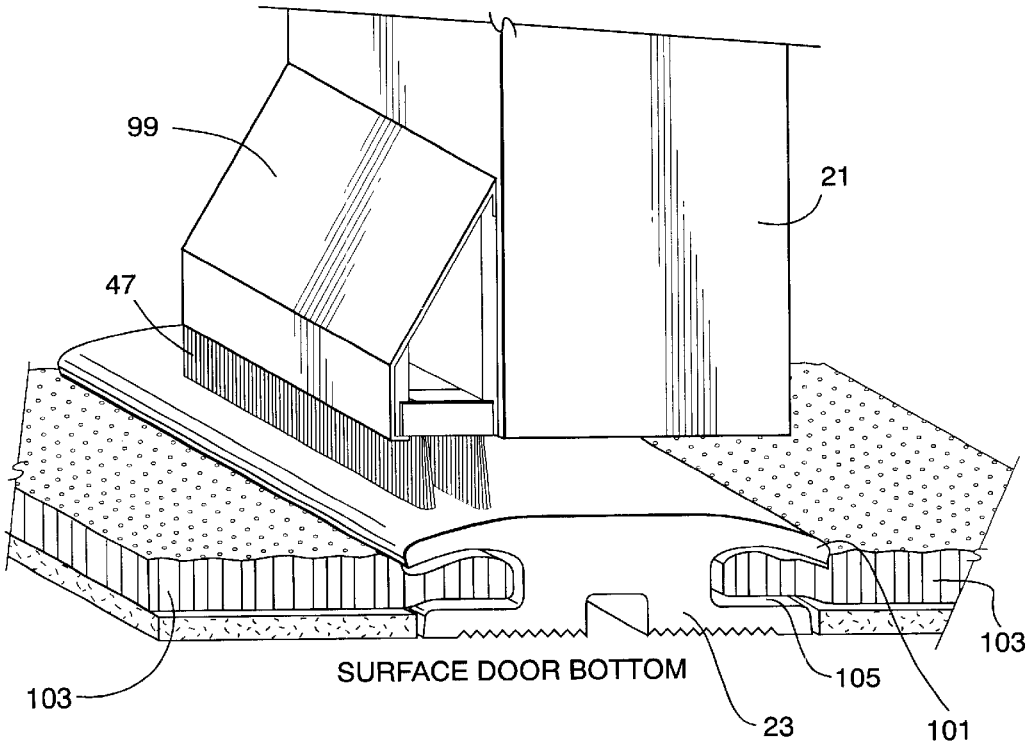
FIG. 12 is a perspective partial cross-sectional view of a door threshold which is being utilized in conjunction with the FIG. 10 embodiment of this invention.

FIG. 11 is a perspective and partial cross-sectional view of a door threshold being utilized in conjunction with any of the embodiments of FIGS. 2–3 or 7–9. The door threshold 23 includes overhanging portions 101 which enable carpet 103 to be tucked into cavities 105. FIG. 12 illustrates the same threshold 23 being utilized in conjunction with the FIG. 10 embodiment of this invention.

In certain embodiments of this invention, a heat indicator (e.g., with the word "fire" thereon) may be provided on the door or on a sealing member or seal support so as to become visible when the temperature on the other side of the door reaches a predetermined level. The thermometer could be on the face of the door frame, or on the top of the door, or at any other suitable location; and would be electrically or otherwise in communication with the fire indicator.

Once given the above disclosure, many other features, modifications, and/or improvements will become apparent to the skilled artisan. Such other features, modifications, and improvements are therefore considered to be a part of this invention, the scope of which is to be determined by the following claims.

What is claimed is:

1. A door bottom seal comprising:

a door having a cavity defined in a bottom surface thereof;

a seal support being provided at least partially in said cavity;

said seal support including at least first and second elongated channels which are approximately parallel to one another;

first and second elongated and removable seal inserts positioned in said first and second elongated channels, respectively, wherein each of said first and second removable inserts includes a plurality of spaced apart sealing members extending downwardly toward a door threshold; and wherein said sealing members of said first insert at least partially overlap respective gaps between sealing members of said second insert in order to reduce light flow through the door bottom seal while permitting air flow through the door bottom seal.

2. The door bottom seal of claim 1, further comprising a third elongated and removable seal insert positioned in a third elongated channel in said support, said third insert including a plurality of spaced apart and approximately aligned sealing members extending downwardly toward a door threshold.

3. The door bottom seal of claim 2, wherein said sealing members of said second insert at least partially overlap respective gaps between sealing members of said third insert in order to reduce light flow through the door bottom seal while permitting air flow through the door bottom seal.

4. The door bottom seal of claim 1, further comprising a side sealing member extending from said seal support in a direction approximately perpendicular to said seal members of said first insert.

5. A door bottom seal comprising:

a support member for attachment to a bottom portion of a door;

first and second spaced apart and approximately parallel sealing members extending from said support member;

wherein said first sealing member is laterally offset from said second sealing member in a lengthwise direction along the bottom portion of the door so that ends of said first sealing member are offset from ends of said second sealing member in the lengthwise direction along the bottom portion of the door.

6. The seal of claim 5, wherein said sealing members comprise flexible fins.

7. The seal of claim 5, wherein said support member is affixed at least partially in a cavity or recess defined in a bottom surface of a door.

8. The seal of claim 5, wherein said support member is located adjacent a bottom surface of a door.

9. The seal of claim 5, wherein said sealing members are flexible, and are provided on different inserts that are removable received in or attached to said support.

10. A door bottom seal comprising:

a support member for attachment to a bottom portion of a door;

first and second spaced apart and approximately parallel sealing members extending from said support member, said first and second sealing members being shaped so as to allow air flow through said seal while preventing substantial portions of light from passing through said seal; and wherein said first and second sealing members are each elongated, each have holes or apertures defined therein, and are approximately parallel to one another.

11. The door bottom seal of claim 10, wherein said sealing members extend from removable inserts that are to be inserted in respective channels of a seal support member.

12. The door bottom seal of claim 10, wherein said sealing members comprise flexible bristles.

13. A door bottom seal comprising:

a support member for attachment to a bottom portion of a door;

first and second spaced apart and approximately parallel sealing members extending from said support member, said first and second sealing members being shaped so as to allow air flow through said seal while preventing substantial portions of light from passing through said seal; and wherein said first and second sealing members comprise bristles.

* * * * *